United States Patent [19]

Zuber

[11] Patent Number: 4,581,069

[45] Date of Patent: Apr. 8, 1986

[54] MASTER ALLOY COMPACTED MASS CONTAINING NON-SPHERICAL ALUMINUM PARTICULATE

[75] Inventor: Chester L. Zuber, Evansville, Ind.

[73] Assignee: Aluminum Company of America, Pittsburgh, Pa.

[21] Appl. No.: 631,180

[22] Filed: Jul. 16, 1984

Related U.S. Application Data

[63] Continuation-in-part of Ser. No. 454,274, Dec. 29, 1982, abandoned.

[51] Int. Cl.[4] ..... C22C 1/04; C22C 21/00; C22C 21/02; C22C 21/12

[52] U.S. Cl. ..... 75/245; 75/249; 419/23

[58] Field of Search ..... 419/23, 38; 75/229, 75/249, 228, 246, 247, 245

[56] References Cited

U.S. PATENT DOCUMENTS 3,592,637 7/1973 Brown et al. ..... 75/138

4,129,444 12/1978 Dreyer et al. ..... 75/228

4,252,577 2/1981 Malard ..... 419/23

OTHER PUBLICATIONS

Sands et al, "Powder Metallurgy", pp. 8, 9 & 14, 1967.

Hirschhorn, "Introduction to Powder Metallurgy", pp. 2–4, 1969.

*Primary Examiner*—Allan M. Lieberman

*Attorney, Agent, or Firm*—Andrew Alexander; John P. Taylor

[57] ABSTRACT

A master alloy compacted mass of particulate metal is fabricated using non-spherical particulated aluminum, such as aluminum sawdust from production operations, in combination with metal particles of a brittle and friable principal metal of the master alloy which is non-malleable and, therefore, non-compactable. The compacted mass retains its homogeneity by the interlocking action of the aluminum sawdust and thereby obviates the need for additional binder despite the non-compactability of the metal particles of the non-malleable principal metal of the master alloy.

14 Claims, 2 Drawing Figures

MASTER ALLOY COMPACTED MASS CONTAINING NON-SPHERICAL ALUMINUM PARTICULATE

CROSS REFERENCE TO RELATED APPLICATIONS

This application is a continuation-in-part of U.S. application Ser. No. 454,274, filed Dec. 29, 1982 and now abandoned.

BACKGROUND OF THE INVENTION

This invention relates to master alloys. More particularly, this invention relates to a master alloy made using non-spherical aluminum particulate as a binder for a non-compactable metal particulate.

In the production of alloys, such as an aluminum base alloy, it is customary to add the alloying metal in a concentrated form sometimes referred to as a master alloy. Thus, for example, to provide an aluminum base alloy containing 2 wt. % manganese, a master alloy containing from 50 to 80 wt. % manganese may be added in the proper proportions (depending upon the manganese content of the master alloy) to smelter grade aluminum to obtain the desired aluminum base alloy. The use of master alloys, i.e., an alloy containing both the principal alloying metal and another metal, such as aluminum, as additives to a molten metal, such as molten aluminum, is made to assist in rapid dissolving of the additive in the molten metal without significant cooling and solidification of the molten bath.

Brown et al, U.S. Pat. No. 3,592,637 describes the use of finely divided mixtures of the alloying metal, referred to as a principal material, and a second metal, referred to as a promoter material, to provide a more rapid dissolving of the added materials in the molten metal bath. The patent points out that the addition of the alloying metal by itself in the form of a finely divided metal powder, such as manganese powder, would be satisfactory. However, it would present difficulties in penetrating the dross on the top of the aluminum, as well as resulting in possible oxidation losses of the manganese. Additionally, there can be dusting and pyrophoricity problems if powder was used. The patent, therefore, provides for the use of pellets formed by pressing powdered mixtures of the principal metal and the promoter metal (e.g., manganese and aluminum).

However, the formation of such pellets of briquettes using finely divided powders can itself introduce pyrophoricity problems in the formation stage of such pellets or briquettes. For example, when finely divided aluminum powder is used as the additional ingredient mixed with the principal metal of the mixture, the finely divided aluminum powder must be carefully handled to prevent uncontrolled oxidation. Furthermore, it is known that finely divided spherical particles do not compact well, thus necessitating the use of a binder to aid in cohesion of the particles which, in turn, adds to the cost of the process.

It is, of course, also known to form sintered particles from finely divided particulate which may be nonspherical. For example, Malard U.S. Pat. No. 4,252,577 discloses a process wherein metal scrap cuttings are used to make sintered pieces by cleaning, grinding, heat treating and sorting metal scrap cuttings.

While pellets or briquettes of master alloys could be formed by sintering, the additional expense involved in forming a sintered product merely as a transitory master alloy form to aid in formation of an aluminum alloy is not justifiable.

In some instances, the master alloy may be formed into a briquette merely by compacting non-spherical particles. However, some alloy materials, such as, for example, manganese, are brittle and friable materials, i.e., non-malleable, and will not compact but rather merely crumble, even though non-spherical particles are utilized. The usual practice, therefore, is to use a binder, such as an organic binder, which will burn off as the master alloy briquette is introduced into the molten metal mass. While this is less expensive than a sintering process, it still involves extra cost, the avoidance of which would be economically advantageous.

SUMMARY OF THE INVENTION

It is, therefore, an object of the invention to provide a master alloy in the form of a compacted mass comprising non-malleable particulate metal and non-spherical aluminum particulate as a binder material.

It is another object of the invention to provide a master alloy comprising a compacted mass of such non-malleable particulate metal and non-spherical aluminum particulate formed without the need for any additional nonmetallic binder.

It is yet a further object of the invention to provide a master alloy comprising a compacted mass of non-malleable particulate metal and non-spherical aluminum particulate wherein the non-spherical aluminum particles function to maintain the integrity of the mass by the interlocking action of the aluminum particles.

It is a further object of the invention to provide a master alloy comprising a compacted mass of non-malleable particulate metal and aluminum "sawdust" which can be treated to remove lubricant therefrom.

These and other objects of the invention will be apparent from the description and accompanying drawings.

In accordance with the invention, a master alloy is provided comprising a compacted mass of non-malleable metal particles of the principal metal of the master alloy material and non-spherical particulated aluminum metal particles wherein the non-spherical aluminum particles comprise aluminum sawdust. The aluminum sawdust itself functions as a binder in the formation of the compacted mass, thereby obviating the need for additional binders.

DESCRIPTION OF THE INVENTION

Figure 1:
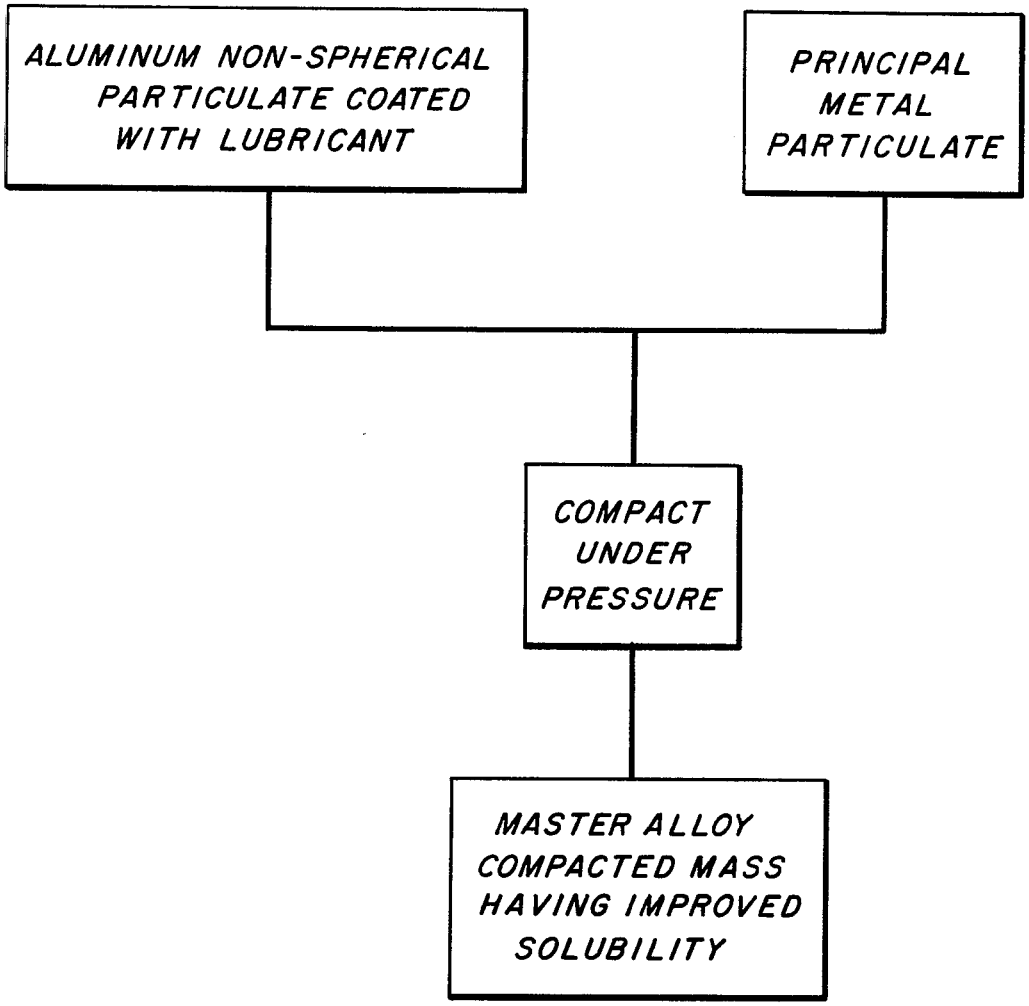
FIG. 1 is a flow sheet illustrating the invention.

A master alloy in the form of a compacted mass, such as a briquette or pellet, is formed by pressing together a mixture of the principal metal of the master alloy in particulate form with non-spherical particles of aluminum. The non-spherical aluminum particles, which are referred to herein as aluminum "sawdust", are the residue of aluminum fabrication operations. The term "aluminum sawdust" as used herein, in accordance with the invention, therefore, may comprise aluminum chips, finely divided scraps, chopped foil and particles from sawing operations and, thus, in marked contrast to the aluminum powder used in the prior art, is characterized as non-spherical. The particle sizes of the aluminum sawdust may range from about −8 to +200 mesh (Tyler Series) although finer particle sizes may be used.

The particulate material of the principal metal is also in powder or finely divided form which may range from 20 to 150 mesh (Tyler Series) although finer particle sizes may be used.

In accordance with the invention, the aluminum sawdust which is used in forming the compacted mass is preferably, at least in part, the residue from fabricating operations, such as sawing, even though a residue of lubricant often remains on the aluminum particles. Aluminum sawdust having lubricant residue remaining thereon may be treated with solvent for purposes of removing it. It will be understood that thermal treatments may also be employed to remove lubricant from the aluminum sawdust.

The principal metal of the master alloy may be one of a number of alloying materials commonly introduced into molten aluminum in the form of master alloys to provide certain desired alloys of aluminum. Examples of such principal metals include manganese, iron and chromium. Other metals, such as copper and silicon, may, in some instances, also comprise the principal metal of the master alloy.

The invention finds particular utility, however, when the principal metal in the master alloy comprises a metal, such as manganese, which, in particulate form, is brittle and friable and, therefore, non-malleable. Prior to the present invention, formation of a master alloy with such a principal metal in particulate form necessitated the use of a binder because of the non-campactability of the metal particulate.

The metal particles are blended together in ratios comprising from 50 to 90 wt. % of the principal metal and from 10 to 50 wt. % of the aluminum sawdust. The blended mixture of materials is then formed into a compacted mass, such as a briquette or a pellet, by pressing in a hydraulic press at a pressure of from 10–30,000 p.s.i., preferably 20,000 p.s.i. It should be emphasized here that the non-spherical shape of the aluminum "sawdust" apparently contributes to the formation of a pellet or briquette having improved resistance to crumbling during subsequent handling.

An important aspect of the present invention resides in the fact that homogeneity can be maintained in the briquette or compacted mass without the addition of a non-metallic binder. That is, the aluminum sawchips function as a binder for the metal particles of the principal metal, e.g., manganese with a particle size range of from 45 to 1000 microns, and the aluminum particles in the briquette. It will be noted that using the aluminum sawchips in this manner has several advantages. That is, conventional briquettes formed using a non-metallic binder have been found to be brittle which results in the generation of fines. The fines can be as much as 5 wt. % of the master alloy being added to the aluminum base alloy. This 5 wt. % is essentially lost since it normally does not enter the aluminum base alloy melt. In contrast, briquettes formed in accordance with the invention have been found to be much less brittle and have reduced amounts of fines resulting, of course, in higher recovery with respect to the use of the master alloy. Further, there is, of course, no need for the additional expense of a non-metallic binder.

EXAMPLE 1

To illustrate the invention, a series of briquettes were made using manganese powder of −20 mesh (Tyler Series) and aluminum sawdust having an approximate particle size in the range of −8 to +100 mesh (Tyler Series) manganese/aluminum ratio of 3:1. The powdered mixture was compacted in a hydraulic press at 2,000 p.s.i. to provide a conventional size of briquettes. The respective briquettes were then added to molten aluminum in a ratio to form an aluminum/manganese alloy containing form 1.25 to 1.3 wt. % manganese. The results are shown below in Table I.

TABLE I

| Type Briquette | Number of Charges | Average Recovery | Solubility |
|---|---|---|---|
| Aluminum Sawdust | 4 | 87% | 92% |
| Control A | 12 | 93% | 95% |
| Control B | 12 | 87% | 90% |
| Control C | 11 | 98% | 110%* |

*This type of commercial briquette was found to contain higher than 75% manganese.

It will be noted that the average recovery of manganese in the melt, as well as the solubility, is comparable to that of conventional briquettes made using finely divided (pyrophoric) aluminum powder. It will be further noted that the third commercial briquette, denoted as Control C, had a solubility of 110% indicating that the particular brand of briquettes actually contained more than 75% manganese content. Therefore, the recovery of 98% may not be a true comparison with the other three samples.

EXAMPLE 2

Figure 2:
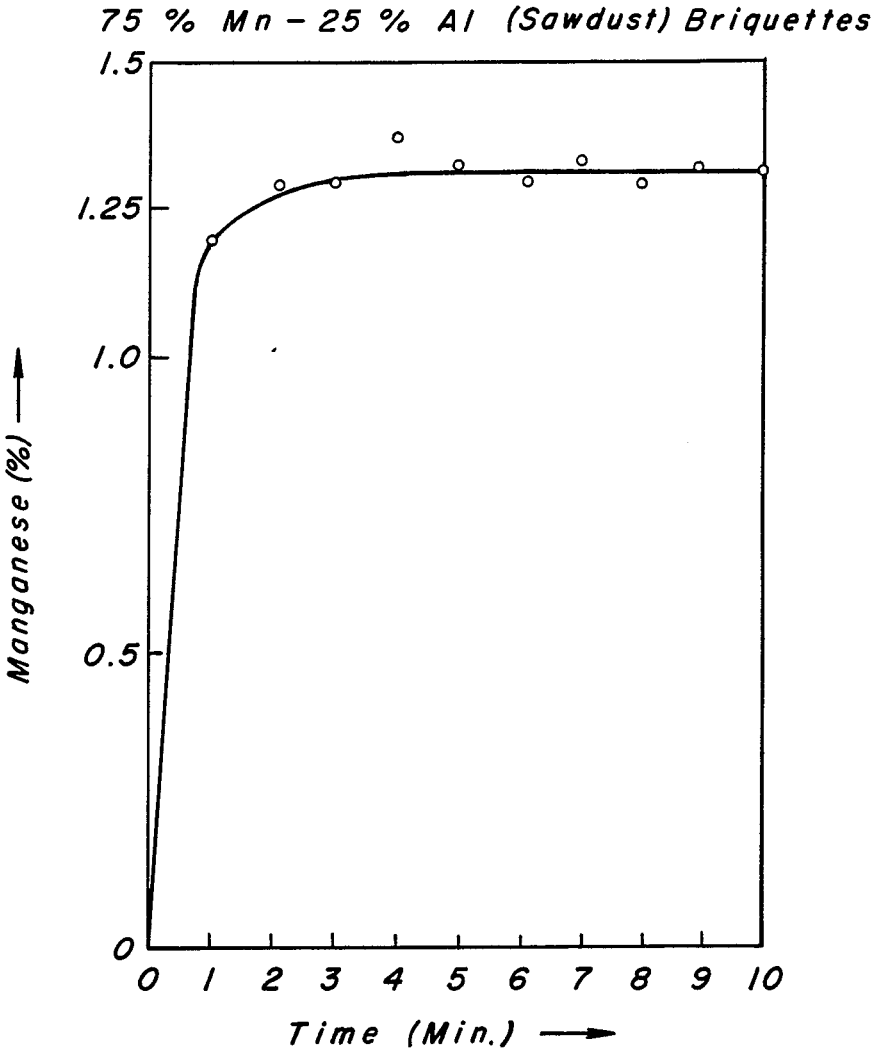
FIG. 2 is a graph illustrating the solubility of a master alloy constructed in accordance with the invention.

To further illustrate the solubility of the master alloy compacted mass of the invention, briquettes formed in accordance with the invention and conventional briquettes were used to form an aluminum base alloy containing 1.25 wt. % manganese. The aluminum base alloys were formed by the addition of the respective master alloy briquettes to a 40 kilogram crucible melt of 3004 alloy at 760° C. In each instance, after the briquettes were charged, the melt was stirred for 10 minutes with samples being taken for analysis at one-minute intervals. The manganese content in each instance was then plotted against time with the slope of the curve showing the solution rate. The curve for the solution rate produced using the master alloy compacted mass of the invention is illustrated in FIG. 2. The dissolution times for the master alloy of the invention and the conventional master alloys are summarized below in Table II. In Table I, it is indicated that the master alloy produced in accordance with the invention using aluminum sawdust actually dissolves and forms the desired alloy faster than any of the commercial master alloy briquettes currently in use which were tested.

| Type Briquette | Time for 1.25% Mn to alloy (min.) |
|---|---|
| Aluminum Sawdust | 1.7 |
| Control A | 2.2 |
| Control B | 4.3 |
| Control C | 3.9 |
| Control D* | 3.7 |

*Control D briquettes were the same as Control B except that the binder used in Control B briquettes was not baked off prior to use.

EXAMPLE 3

To further illustrate the usefulness of the invention in providing a mixture needing no additional binders, even when the principal metal of the master alloy is a brittle, non-malleable metal which will not compact, particulate manganese having an average particle size range of 45–425 microns was compacted as in Example 1 without, however, using either aluminum sawdust or any conventional binders. The resultant briquettes easily crumbled and were totally useless for the purpose intended, i.e., to add the manganese as a compacted mass to molten aluminum for alloy formation. When the same experiment is modified by the addition of spherical particles of aluminum, however, the results are the same as in Example 1.

Thus, the invention provides an improved master alloy compacted mass consisting essentially of aluminum sawdust and normally non-compactable, brittle and friable master alloy metals which is more resistive to crumbling, needs no additional binders, rapidly dissolves into a molten metal mass, and can be formed from relatively inexpensive residues or waste materials from aluminum fabrication operations.

Having thus described the invention, what is claimed is:

1. A master alloy comprising a compacted mass of metal particles consisting essentially of from 10 to 50 wt. % of non-spherical particulated aluminum sawdust having a particle size ranging from smaller than 200 mesh to −8 mesh (Tyler Series) and from 50 to 90 wt. % of non-malleable metal particles of the principal metal of the master alloy material having a particule size range of from smaller than 150 mesh to 20 mesh (Tyler Series).

2. The master alloy compacted mass of claim 1 wherein said compacted mass is characterized by the absence of non-metallic binders.

3. The master alloy compacted mass of claim 1 wherein said non-spherical particles of aluminum comprise aluminum sawdust from fabricating operations which contain lubricant.

4. The master alloy compacted mass of claim 3 wherein said aluminum sawdust particles are treated prior to compacting to remove a substantial amount of said lubricant.

5. The master alloy compacted mass of claim 4 wherein said compacted mass of master alloy retains homogeneity of the aluminum sawdust and metal particles of the principal metal.

6. The master alloy compacted mass of claim 1 wherein said non-spherical particulated aluminum comprises aluminum sawdust from fabricating operations and said aluminum sawdust and non-malleable metal particles are compacted under pressure to form said compacted mass and said aluminum sawdust functions as a mechanical interlocking binder to promote compaction and adherence of the particle mixture thereby obviating the need for an additional binder.

7. The metal alloy compacted mass of claim 6 wherein said non-malleable metal particles of the principal metal of the master alloy material comprise non-compactable manganese particles.

8. A master alloy comprising a compacted mass of metal particles consisting essentially of from 10 to 50 wt. % of non-spherical particulated aluminum sawdust from fabricating operations and having a particle size ranging from smaller than 200 mesh to −8 mesh (Tyler Series); and from 50 to 90 wt. % of non-malleable metal particles of the principal metal of the master alloy having a particle size range of from smaller than 150 mesh to 20 mesh (Tyler Series), said non-malleable metal particles being incapable of independently forming a compacted mass in the absence of binder materials.

9. The compacted mass of claim 8 wherein said non-malleable metal particles of the principal metal of the master alloy comprise manganese particles.

10. A method of making a master alloy compacted mass from metal particles of a non-malleable principal metal of the master alloy in the absence of nonmetallic binders which comprises the steps of mixing from 50 to 90 wt. % of said non-malleable metal particles having a particle size range of from 45 to 1000 microns with from 10 to 50 wt. % of nonspherical aluminum sawdust from fabricating operation and having a particle size ranging from smaller than 200 mesh to −8 mesh (Tyler Series), compacting the particulate mixture together and maintaining the shape of the compacted mass by utilizing mechanical interlocking action of said non-spherical aluminum sawdust.

11. The method of claim 10 including the step of removing non-metallic binders from the aluminum sawdust prior to said compacting.

12. The method of claim 11 including removing said binders by heating.

13. The method of claim 10 wherein said non-malleable principal metal consists of manganese metal.

14. The method of claim 13 wherein said mixture comprises 95 wt. % manganese.

* * * * *